United States Patent [19]

Trützschler

[11] 4,190,932

[45] Mar. 4, 1980

[54] METHOD AND APPARATUS FOR OPENING TEXTILE FIBER BALES

[75] Inventor: Hans Trützschler, Monchen-Gladbach, Fed. Rep. of Germany

[73] Assignee: Trützchler GmbH & Co. KG., Monchen-Gladbach, Fed. Rep. of Germany

[21] Appl. No.: 916,370

[22] Filed: Jun. 16, 1978

[30] Foreign Application Priority Data

Jul. 14, 1977 [DE] Fed. Rep. of Germany ..... 2731811

[51] Int. Cl.[2] ..... D01G 7/04

[52] U.S. Cl. ..... 19/81; 177/119; 177/121

[58] Field of Search ..... 19/80 R, 81, 239, 240, 19/241; 209/599; 73/78, 81, 85; 177/119–121

[56] References Cited

U.S. PATENT DOCUMENTS

| | | | |
|---|---|---|---|
| 3,660,866 | 5/1972 | Jagst | 19/81 |
| 3,939,929 | 2/1976 | Hidaka | 177/121 |

FOREIGN PATENT DOCUMENTS

| | | | |
|---|---|---|---|
| 436658 | 10/1935 | United Kingdom | 177/119 |

*Primary Examiner*—Louis Rimrodt

*Attorney, Agent, or Firm*—Haseltine, Lake & Waters

[57] ABSTRACT

An arrangement for opening textile fiber bales in which a row of textile fiber bales are broken up by at least two needle tables or rollers placed small distances apart in a row from their bottom side. The distance between the needle points of successive needle tables or rollers are continuously variable. Furthermore, the distance between needle points is changed automatically depending on properties inherent to the textile fiber bales or fiber tufts during operation of the needle table. The actual characteristic value of the detached fiber is compared with a nominal characteristic value, and a different signal is generated and applied as a control on a correcting element. The correcting element varies the distance between the needle points. Disturbance effects are obtained from the textile fiber bale, and this disturbance produces through a control device, an input or set variables for the distance between the needle points. One disturbance effect of the textile fiber bale may be the hardness.

10 Claims, 3 Drawing Figures

METHOD AND APPARATUS FOR OPENING TEXTILE FIBER BALES

BACKGROUND OF THE INVENTION

The present invention relates to a method for opening textile fiber bales. A row of textile fiber bales are broken up by at least two needle tables or rollers placed small distances apart in a row from their bottom side. The distance between the needle points of successive needle tables or rollers are continuously variable. The arrangement includes apparatus for implementing the method.

In a known method, the distance between the needle points is set manually at the start of operations. The distance selected depends, on the one hand, on the properties of the fiber bales to be opened and, on the other hand, the distance determines the amount of fiber detached. The setting, once made, is maintained during the operation of the opening device since there is no provision made for adjustment.

It is, therefore, an object of the present invention to provide a method and apparatus of the above type which permit adjustment of the distance between the points of needles during operation.

Another object of the present invention is to provide an arrangement of the foregoing character which is substantially simple in construction and may be economically fabricated.

A further object of the present invention is to provide an arrangement, as described, which may be readily maintained in service and which has a substantially long operating life.

SUMMARY OF THE INVENTION

The present invention is based on the concept of influencing the detached amount of fiber by the variable factors arising during the opening process. Such variable factors are all properties pertaining to the material such as type of fiber, baling pressure, moisture, etc. The amount of detached fiber itself is also such a variable factor. By varying the distance between needles during operation, production fluctuations resulting from bale hardness, fiber type or bale weight can be compensated. The amount of fiber attached can be regulated with ease. In case of deviations between actual and nominal quantity, the distance between the points of the needles is varied by means of an adjustment drive. Either too many or too few tufts are detached till the pre-set nominal quantity is attached.

Also, the amount of detached fiber tufts can be controlled to advantage. For this purpose, variable factors pertaining to the textile fiber bale, e.g., hardness, bale weight, etc. for the textile fiber bale are obtained. They act as disturbance on an adjustment drive for the distance between the points of the needles.

The present invention also includes apparatus for implementing the method in accordance with the invention. In this apparatus the variation of the detached amount of fiber is determined by a weighing device and delivered via a regulator to a correcting element which varies the distance between needle points. A digital control, for example, a two-position or three-position control, can be used. As correcting element it is expedient to use a motor which moves the needle table via a spindle. The motor is attached to the needle table. The spindle has both right-hand and left-hand threads. The needle tables are moved relative to each other during rotation of the motor via nuts which are solidly connected to both needle tables.

As disturbance elements, it is expedient to use the hardness of the bale, with a needle roller, a needle crosswise arrangement, etc. being used as hardness testing device. This hardness testing device is placed immediately ahead of the detaching needle tables and can be pushed into the textile fiber bales by a spring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE PREFERRED EMBODIMENTS

Figure 1:
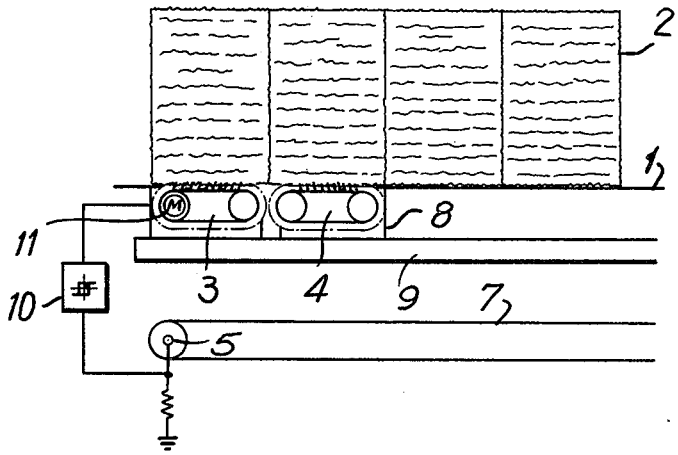
FIG. 1 is a schematic view and shows a regulating apparatus for implementing the method according to the invention.

FIG. 1 shows a surface 1 on which ten bales 2 are placed next to one another in one row. Underneath the surface 1 are two needle tables 3, 4 whose length is approximately equal to the length of one bale 2. Underneath the needle tables 3, 4 a moving belt 7 runs between a roller 5 and a roller (not shown).

The distance between adjacent needle tables 3, 4 is varied continuously by mutual displacement of needle tables 3, 4. The needle tables 3, 4 are mounted in a transport carriage 8, which travels on frame 9 of the apparatus. The moving belt 7 is constructed as a weighing device to determine the amount of fiber detached. This weighing device is the measuring element of a control loop which also comprises a control 10 and a motor 11 as correcting element. The motor 11 travels on transport carriage 8.

During operation, the moving belt 7, equipped as weighing device, measures the amount of detached fiber. After conversion as controlled condition, a digital electrical signal is obtained from this weight. This weight signal via the control 10 produces a manipulated or input variable which acts upon motor 11. By starting and stopping motor 11, a variation of the distance between the needle points of needle tables 3, 4 is accomplished.

Figure 2:
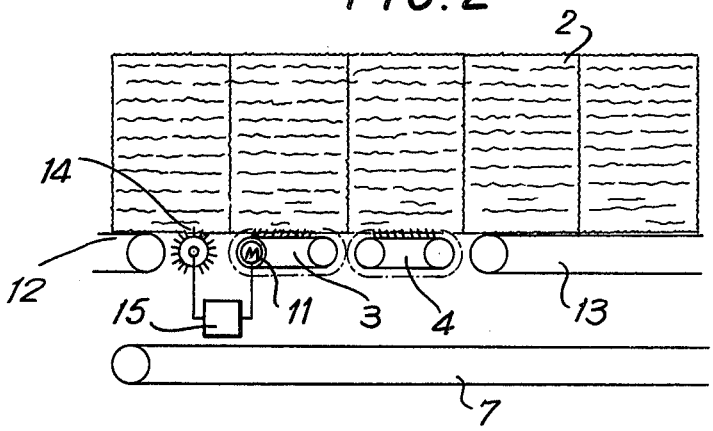
FIG. 2 is a schematic view and shows a control apparatus for implementing the method according to the invention.

According to FIG. 2, underneath a row of adjacent textile fiber bales 2 there are two needle tables 3, 4 whose length corresponds approximately to the length of a textile fiber bale 2. The textile fiber bales 2 lie directly on the needle tables 3, 4 and are moved back and forth by them. During the fiber detaching process, the needle tables 3, 4 remain stationary. Bale transport tables 12, 13 are located on one head end in a row with the needle tables 3, 4. Between the bale transport table 12 and one needle table 3, a needle roller 14 is provided as hardness testing device. The rotary needle roller 14 obtains from the textile fiber bales 2 variable degrees of hardness as disturbing control magnitudes which are delivered as input or manipulated variable via a control device 15 to the motor 11 as the correcting element. Motor 11 varies the distance between the needle points of needle tables 3, 4 accordingly.

Figure 3:
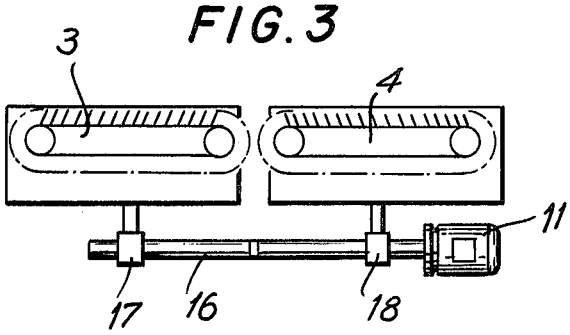
FIG. 3 is a side view and shows a correcting element for varying the distance between needle points.

FIG. 3 shows a correcting element for varying the distance between the needle points of needle tables 3, 4. For this purpose, nut 17 is connected to needle table 3 and nut 18 is connected to needle table 4. Nuts 17 and 18 are threaded on a common spindle 16. Spindle 16 is driven by motor 11. Nut 17 and its associated region on the spindle 16 has a left-handed thread, nut 18 and its associated region of spindle 16 has a right-handed thread. Upon rotation of motor 11, a rotation of spindle 16 results in a displacement of nuts 17, 18 and hence a displacement of needle tables 3, 4.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What I claim is:

1. A method for opening textile bales comprising the steps of: breaking up a row of textile fiber bales by at least two needle tables placed small distances apart in a row from a bottom side of the fiber bales, said needle tables having needle points with distance between needle tables being continuously variable; and changing said distance automatically depending on predetermined properties inherent to said bales during operation of said needle tables.

2. A method as defined in claim 1, including the step of comparing an actual characteristic value of the detached fiber with a nominal characteristic value; generating a comparison difference signal; and varying the distance between said needle points as a function of said difference signal, said distance between said needle points being varied by a correcting element to which said difference signal is applied.

3. A method as defined in claim 1, including the step of producing a set variable for the distance between said needle points by a disturbance effect comprising variation of predetermined properties obtained from a textile fiber bale, said set variable being produced by a control device.

4. A method as defined in claim 3, wherein said disturbance effect comprises hardness of said textile fiber bales.

5. A method as defined in claim 3, wherein said disturbance effect comprises weight of said textile fiber bale.

6. A method as defined in claim 1, wherein said needle tables comprise endless belts mounted on rollers.

7. Apparatus for opening textile fiber bales, comprising at least two needle tables for breaking up a row of textile fiber bales, said needle tables being placed small distances apart in a row from a bottom side of the fiber bales; said needle tables having needle points with distances between needle tables being continuously variable; means for changing said distance automatically depending on predetermined properties inherent to said bales during operation of said needle tables; means for weighing an amount of detached fiber; and control means connected to said weighing means for changing said distance between needle tables as a function of weight of detached fiber.

8. Apparatus as defined in claim 7, including motor means in said control means for displacing at least one of said needle tables.

9. Apparatus for opening textile fiber bales comprising at least two needle tables for breaking up a row of textile fiber bales, said needle tables being placed small distances apart in a row from a bottom side of fiber flakes; said needle tables having needle points with distances between needle tables being continuously variable; control means for changing said distance automatically depending on a disturbance effect obtained from said textile fiber bales, said disturbance effect producing through said control means a set variable for the distance between said needle tables; said disturbance effect comprising hardness of said textile fiber bales; and hardness testing means for predetermining said disturbance effect.

10. Apparatus as defined in claim 11, wherein said hardness testing means comprises a needle roller.

* * * * *